United States Patent [19]

Gevers

[11] 4,094,086

[45] June 13, 1978

[54] ADJUSTING DEVICE FOR DOUBLE-BARRELLED GUNS

[75] Inventor: Georges A. Gevers, Liege, Belgium

[73] Assignee: Fabrique Nationale Herstal S.A. en abrege FN, Herstal, Belgium

[21] Appl. No.: 741,987

[22] Filed: Nov. 15, 1976

[30] Foreign Application Priority Data

Jan. 22, 1976 Belgium ..... 254770

[51] Int. Cl.[2] ..... F41C 21/06

[52] U.S. Cl. ..... 42/1 R; 42/76 R

[58] Field of Search ..... 42/75 A, 75 B, 75 C, 42/75 D, 76 R, 1 R; 89/41 A

[56] References Cited

U.S. PATENT DOCUMENTS

| | | | |
|---|---|---|---|
| 2,949,825 | 8/1960 | Musser et al. | 89/41 A |
| 3,098,410 | 7/1963 | Giza | 89/41 A |
| 3,353,291 | 11/1967 | Musser | 89/41 A |
| 3,550,300 | 12/1970 | Roder | 42/1 R |
| 3,955,299 | 5/1976 | Bullis | 42/1 R |

*Primary Examiner*—Charles T. Jordan

*Attorney, Agent, or Firm*—Bacon & Thomas

[57] ABSTRACT

The invention pertains to an adjusting device for double-barrelled guns, characterized by the fact that it consists principally of two elements provided with accessory parts located between the barrels, one of these parts forming an incline for the other which acts as a wedge, one at least of aforesaid elements being capable of being moved wth respect to the other.

6 Claims, 3 Drawing Figures

ADJUSTING DEVICE FOR DOUBLE-BARRELLED GUNS

The present invention relates to an adjusting device for double-barrelled guns.

It is usual in such arms to provide for a certain convergence of the centerlines of the barrels so as to adjust the point of impact, this being variable according to the purpose of the arm (sporting, skeet, trap, . . . ) and to the particular requirements of the user.

This adjustment has always consisted in an extremely delicate, slow, and often problematic job of work.

The purpose of the invention is to supply a simple and cheap device, permitting the desired adjustment of the barrels quickly and with precision.

This device mainly comprises two elements provided with accessory parts located between the barrels, one of these parts consisting of an incline for the other part which forms a wedge, one at least of said elements being capable of being moved with respect to the other.

Merely for the purpose of illustration, a practical example of the use of the invention shall be described hereinafter with reference to the appended drawing, relative to a gun with superposed barrels.

FIG. 1 of the drawing shows a side view of two superposed barrels fitted with a device according to the invention;

Figure 1:
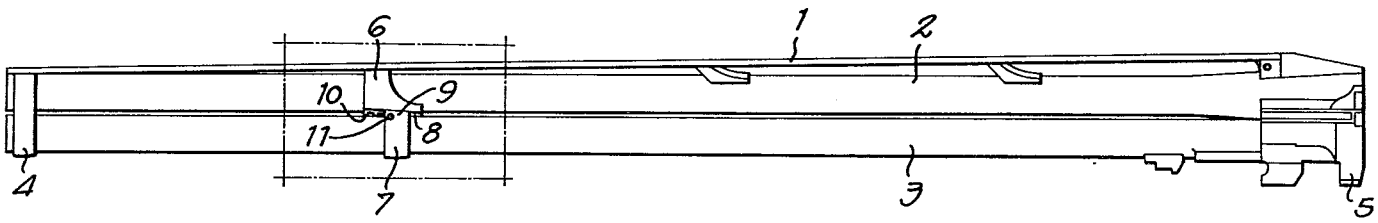

In FIG. 1, we see the sight strip 1, the upper barrel 2 and the lower barrel 3.

In the proximity of their mouths, the barrels are fitted in a double ring 4 which is integral with the sight strip 1, whereas they are both attached to each other by the breech 5 at their other end.

The adjusting device according to the invention is in the present case made up of a first element 6, in the shape of a ring which surrounds barrel 2 and is attached to same, and by a second element 7, in the form of a ring which surrounds barrel 3.

Figure 3:
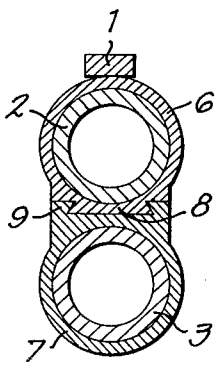
FIG. 3 is a cross-section according to line III—III in FIG. 2.
Figure 2:
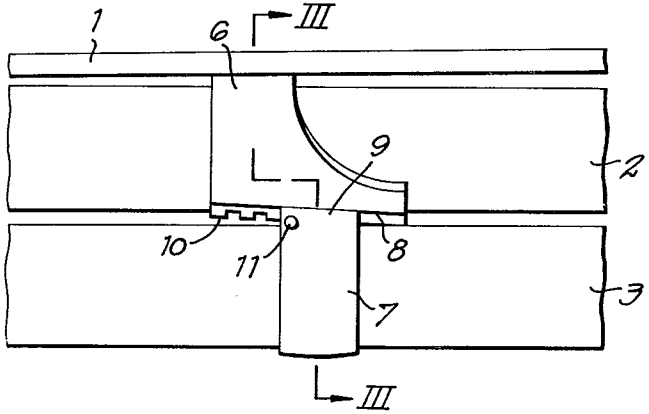
FIG. 2 illustrates the adjusting device drawn to a larger scale.

These elements 6 and 7 are provided with accessory parts located between the barrels, one of which forms an inclined surface 8 for the other which forms a wedge 9, the two accessory parts being on the other hand joined together by a dovetail arrangement (see FIG. 3).

It is obvious that the movement of part 9 along the incline 8 modifies the spacing of the barrels 2 and 3 at that location. As on the other hand the spacing of the barrels is fixed at both ends thereof, it is quite clear that an alteration of the intermediate spacing of the barrels by the above-described device will entail a curving of the barrels, either in the sense of convergence at the mouths, or in that of a divergence, which is made possible by the dovetail arrangement.

As illustrated, incline 8 is provided with a notch arrangement 10 and wedge 9 with a corresponding rod 11. Both elements can consequently be locked with respect to each other in the desired position.

The parts being built and assembled in the factory, it is easy to determine with sufficient precision, the degree of convergence for each of the relative positions of elements 6 and 7. This information may accompany the arm, thereby greatly facilitating the adjustment.

According to a particular characteristic of the invention, the curving of the barrels due to the action of the adjusting device described may be varied by providing one barrel with a wall thickness which is different from that of the other barrel.

It is quite obvious that various alterations may be made in the described device, without going beyond the scope of the present invention as defined in the following claims.

What I claim is:

1. Adjusting device for double-barrelled guns, comprising two elements provided with accessory parts located between the barrels, one of these parts forming an axially extending incline for the other which acts as a wedge, one at least of aforesaid elements being movable axially with respect to the other.

2. Device according to claim 1, characterized by the fact that the two elements are in the shape of rings, each of which surrounds one of the barrels, one of said rings being fixedly attached to the corresponding barrel.

3. Device according to claim 1, characterized by the fact that said incline and wedge are joined together by dovetail arrangements.

4. Device according to claim 1, characterized by the fact that a means is provided to selectively lock the two elements in their desired relative positions.

5. Device according to claim 4, characterized by the fact that aforementioned means consists of a notch arrangement on the part forming the incline, and a rod which is carried by the other part and engageable in said notch.

6. Device according to claim 1 wherein said barrels are fixed to each other at their forward and rear ends, said adjusting device being intermediate the ends of said barrels.

* * * * *